United States Patent [19]

Blanchard

[11] Patent Number: 4,807,334

[45] Date of Patent: Feb. 28, 1989

[54] ARTICLE HANGER CLIP

[75] Inventor: Russell O. Blanchard, Zeeland, Mich.

[73] Assignee: Batts, Inc., Zeeland, Mich.

[21] Appl. No.: 187,508

[22] Filed: Apr. 28, 1988

[51] Int. Cl.[4] ..... A44B 21/00

[52] U.S. Cl. ..... 24/487; 24/543; 24/557; 223/91

[58] Field of Search ..... 24/487, 489, 557, 543, 24/545, 346; 223/91, 96, 85, 87

[56] References Cited

U.S. PATENT DOCUMENTS

| | | | |
|---|---|---|---|
| 3,604,071 | 9/1971 | Reimels | 24/543 |
| 3,665,563 | 5/1972 | Batts | 24/543 |
| 3,698,043 | 10/1972 | Batts | 223/91 |
| 3,755,859 | 9/1973 | Solari | 24/487 |
| 3,982,307 | 9/1976 | Smith et al. | 24/543 |
| 4,536,924 | 8/1985 | Willoughby | 24/487 |
| 4,589,171 | 5/1986 | McGill | 24/543 |
| 4,638,930 | 1/1987 | Blanchard | 223/96 |

*Primary Examiner*—Victor N. Sakran

*Attorney, Agent, or Firm*—Price, Heneveld, Cooper, DeWitt & Litton

[57] ABSTRACT

A molded plastic article clamp designed to be supported from a rod has a pair of jaws pivotally joined at the top. One jaw has a pair of integral latch members extending toward the other jaw. The latch members are spaced apart lengthwise of the jaws and are designed to engage spaced keepers on the other jaw. The length and spacing of the latch members is such that when the latch member and keeper furthest from the top are engaged the jaws are held in article clamping position. When the other latch and keeper combination are engaged, the jaws are held in an open position sufficient to release an article but the clamp is still retained on the rod.

7 Claims, 1 Drawing Sheet

ARTICLE HANGER CLIP

FIELD OF THE INVENTION

This invention relates to article clamps designed to seat over and be supported from a rod or wire.

BACKGROUND OF THE INVENTION

The use of molded plastic clamps for displaying various types of articles, such as items of clothing, carpet samples and a wide variety of other types of articles, is well-known. Clamps of this type are disclosed in U.S. Pat. No. 3,698,043 entitled MOLDED GARMENT CLAMP, issued Oct. 17, 1972 to J. H. Batts. Clamps designed to be suspended from wires are disclosed in U.S. Pat. No. 3,665,563 entitled CLAMP, issued May 30, 1972 to J. H. Batts.

While both types have proven themselves to be very effective, it would be desirable to overcome some of the shortcomings of these clamps. These prior art clamps either have to be threaded onto the supporting rod from one end or be so made that they can be opened and seated over the rod. To use the first type, the end of the rod must provide unobstructed access, an arrangement which has a number of drawbacks. Use of the second type is undesirable because the clamps, when open, can be dislodged from the rod and become lost or damaged. A compromise in which the second type, once mounted on the rod, is secured by a spring clip or the like is disclosed in U.S. Pat. Nos. 4,638,930 entitled HANGER LEG MOUNTING STRUCTURE FOR A SUPPORT ROD, issued Jan. 27, 1987 to R. O. Blanchard and U.S. Pat. No. 4,660,750 entitled GARMENT HANGER WITH IMPROVED WIRE SUPPORT, issued Apr. 28, 1987 to R. O. Blanchard. While the use of the spring clip eliminates the problem of inadvertent displacement from the rod, many users considered it too difficult to remove to permit mounting or removal of the clamp.

None of these provide an adequate solution to providing a clamp which can be mounted simply by seating it over the rod and then easily and simply secured against inadvertent release. None of these devices provide an arrangement in which the clamp, after being secured to the rod can later be easily released.

BRIEF DESCRIPTION OF THE INVENTION

The clamp of this invention has a pair of latches. One of the latches is of the type conventionally provided for holding the legs of the clamp in closed, article gripping position. The use of an integral latch for holding the jaws of an article clamp in closed position is disclosed in U.S. Pat. No. 3,698,043, noted above. The second latch only operates after the first one has been released and serves to prevent the legs separating more than is necessary to release an article and reload the clamp. Thus, unless both latches have been intentionally released, the clamp remains anchored to the rod against inadvertent displacement.

DESCRIPTION OF THE PREFERRED EMBODIMENT

Figure 1:
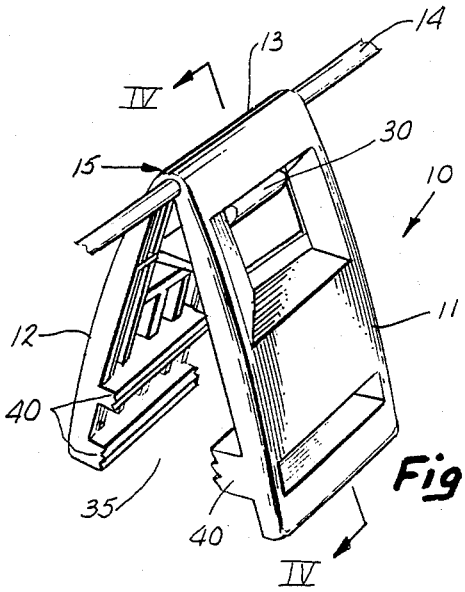
FIG. 1 is an oblique view of the clamp of this invention opened to receive an article.
Figure 2:
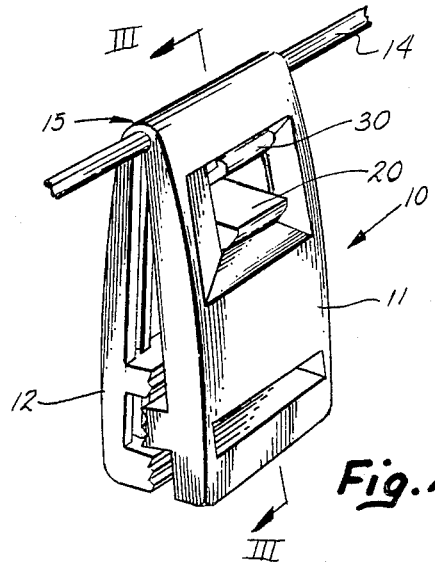
FIG. 2 is a view similar to FIG. 1, except the clamp is closed to hold an article.

Referring to FIG. 1, the numeral 10 refers to a clamp having a forward leg 11 and a rearward leg 12 joined at the top by a hinge 13. As will be seen from FIGS. 6 and 7, the legs 11 and 12 are molded as a single integral member joined by a thinner web which serves as the hinge 13. A suitable material for this purpose is polypropylene. When the legs are folded toward each other in the step of mounting the clamp on a support such as the rod 14, the web serving as the hinge wraps around the rod and forms a socket 15 to seat the rod as indicated in FIGS. 1 and 2.

Figure 3:
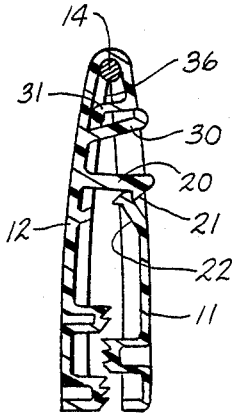
FIG. 3 is a sectional elevation view taken along the plane III—III of FIG. 2.

To stiffen the legs 11 and 12, the inside faces of the legs are reinforced by ribs 16, the upper ends of which substantially meet to all but close the socket 15 about the rod 14. This stabilizes the clamp 10 on the rod 14 when the clamp is closed on an article as shown in FIGS. 2 and 3.

To hold the legs of the clamp in closed, article gripping position, a lower latch arm or member 20 is provided. The lower latch member is integral with the rear leg 12 and extends forwardly terminating in a downwardly extending latch finger 21 at its forward end. The latch finger 21 is designed to seat over and engage with the latch keeper 22 which is formed by the lower edge of the latch opening 23 in the forward leg. When the latch finger 21 is engaged with the latch keeper 22, the front leg 11 is held in its article clamping position as illustrated in FIG. 2. The top of the finger 21 extends further forward than the lower end, providing a ridge against which an operator can press a finger to lift the latch finger to release the front leg. The plastic from which the clamp is molded provides sufficient resilience to permit this to be done.

The lower edge of the latch opening 23 is inclined upwardly and inwardly and at its inner end has an upwardly extending lip 25 over which the latch finger 21 seats to restrain further pivotal separation of the jaws. The lower edge of the latch opening including the lip 25 is reinforced by the ribs 16 which merge into its lower surface. This is important because the jaws, when so closed, must exert sufficient closing pressure to positively grip the article about which the jaws are clamped. This condition does not apply to the upper arm when it is latched.

The released legs 11 and 12, due to their inherent resilience, will separate until the upper latch arm 30 engages the upper edge of the latch opening which serves as the upper latch keeper 31. The upper edge extends inwardly forming a leg at the inner end of which is the downwardly extending lip 27 over which the upper latch finger 30 seats to limit release pivotal movement of the jaws. The length of the leg in cooperation with its greater proximity to the socket 15 provides the additional pivotal movement required to release a clamped article.

Figure 4:
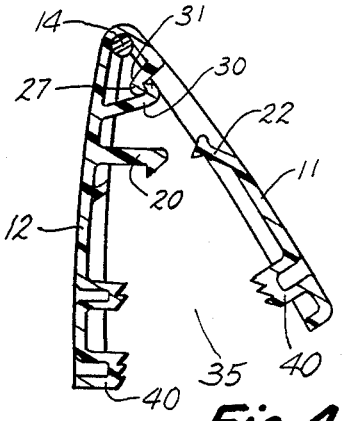
FIG. 4 is a sectional elevation view taken along the plane IV—IV of FIG. 1.
Figure 5:
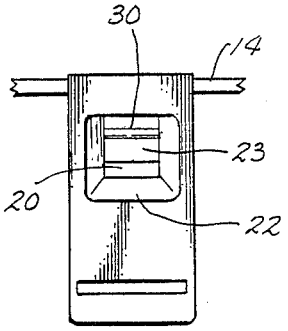
FIG. 5 is a front elevation view of the invention in closed position.

Engagement of the lip 27 with the upper latch finger limits the opening of the clamp as indicated in FIGS. 1 and 4. In this open position, articles can be removed from or placed in the central pocket 35 of the clamp. However, the clamp remains attached to the rod 14. With the separation of the arms so limited, the socket 15 will remain sufficiently closed that it will maintain its grip on the rod 14. However, should it for any reason be dislodged from this grip it will not be entirely free from the rod because the rod will remain trapped in the space 36 formed between the web 13 and the upper latch arm 31 (FIG. 4). The forward end or head of the upper latch arm 31 has the same shape as that of the lower latch arm except the finger 38 extends upwardly and the arm itself is biased upwardly. The upper latch arm does not have to be manipulated during normal use of the clamp. However, if it is desired to remove the clamp from the rod 14, all that has to be done is to press the upper latch finger downwardly which will release the front leg 11, permitting the clamp to be opened sufficiently to remove it from the rod.

In a preferred construction, the length of the upper and lower latch arms is the same or substantially the same. The greater pivotal movement of the jaws permitted by the upper latch arm is the result of its closer proximity to the rod socket 15. In fact, the upper latch arm can be somewhat shorter than the lower one and still provide the desired additional pivotal movement. Thus, it will be seen that the upper and lower latch arms together with the integral portion of the rear jaw which is between them form a forwardly opening U-shaped structure (FIGS. 3 and 4).

Figure 6:
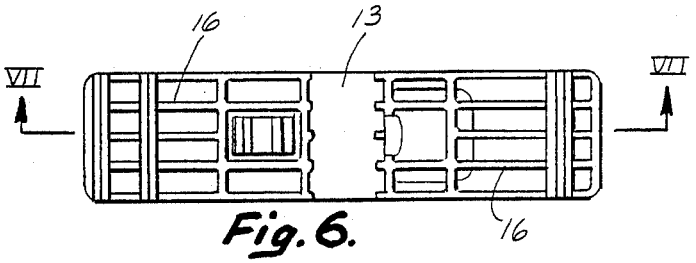
FIG. 6 is an inside view of the clamp in the fully open position, as it was originally molded.
Figure 7:
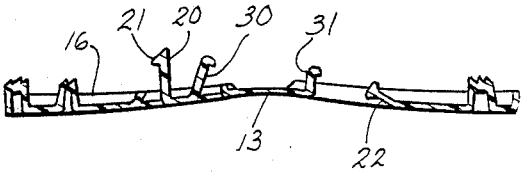
FIG. 7 is a sectional view taken along the plane VII—VII of FIG. 6.

To facilitate the use of the clamp, the resilience of the plastic should bias the jaws into the open position illustrated in FIG. 1. In addition, the legs of the "U" forming the upper and lower latch arms are biased to snap over the edges of the latch opening to automatically restrain jaw movement. This arrangement makes use of the clamp convenient and quick. By molding the clamp in the open position in which the jaws are aligned as shown in FIGS. 6 and 7, the folding of the jaws into their normal operating position provides the desired bias. This can be increased, if desired, by folding the clamp over a slightly oversize rod requiring the web 13 to be stretched.

To assure a positive grip on the articles such as clothing, the clamp may be equipped with teeth 40 designed to engage and hold articles such as garments (FIG. 1). Such teeth are conventional in design and function and do not form any part of this invention.

Figure 8:
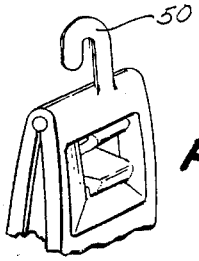
FIG. 8 is a fragmentary oblique view of a modification of the clamp to which this invention has been applied.
Figure 9:
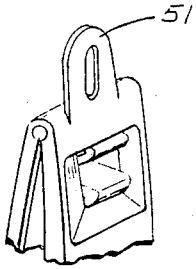
FIG. 9 is a fragmentary oblique view of a further modification of the clamp.

FIGS. 8 and 9 illustrate further modifications in which a hook 50 or eyelet 51 can be provided to support the clamp when it is not on a rod 14 or alternatively to support a plurality of the clamps by so supporting the rod from one or two of the clamps equipped with the hook 50 or eyelet 51. Such auxiliary means of support does not in any way interfere with the use of the invention itself.

Having described my invention and its function, it will be understood that various modifications of the invention can be made without departing from the principles of the invention. Such modifications are to be considered as included in the hereinafter appended claims unless these claims, by their language, expressly state otherwise.

I claim:

1. An article clamp adapted for support from a rod-like member, said clamp having a pair of jaws pivotally joined at their upper ends by an integral flexible web, a latch opening in the forward one of said jaws having vertically spaced upper and lower ends forming latch keepers, a lower latch member integral with the rear jaw and extending forwardly and having a downwardly extending latch finger at its forward end for engaging the lower latch keeper for holding said jaws in closed article gripping position, an upper latch member spaced from and extending forwardly above said lower latch member and having an upwardly extending latch finger at its forward end for engaging the upper latch keeper for limiting the opening movement of said jaws when they are sufficiently separated to release articles which have been held by the jaws when closed.

2. An article clamp adapted for support from a rod-like member, said clamp having a pair of jaws pivotally joined at their upper ends by an integral flexible web, a latch opening in the forward one of said jaws, said latch opening having vertically spaced upper and lower edges forming latch keepers, a pair of latch members integral with the rear one of said jaws, said latch members being vertically spaced and extending forwardly, the lower one thereof having at its forward end a downwardly extending latch finger for engaging said lower edge of the opening when said jaws are closed and in article clamping position, said upper latch member at its forward end having an upwardly extending latch finger for engaging the upper edge of said opening when said jaws are separated and in article releasing position, said jaws being pivotable to aligned position upon disengagement of said upper latch member from the upper edge of said latch opening.

3. An article clamp as described in claim 2 wherein said flexible web forms a socket for the rod-like member when the position of the jaws is limited by either the upper or lower of the latch members, the rod being released from the socket when both of the latch members are disengaged from the edges of the latch opening to permit the forward jaw to pivot enough to fully open the socket and release the clamp from the rod.

4. An article clamp as described in claim 3 wherein said latch members are of substantially the same length with the upper one being substantially closer to the socket to permit the greater arc of pivot movement of said jaws before engaging the upper edge of said opening.

5. An article clamp as described in claim 2 wherein said lower edge of said opening is inclined inwardly forming an inclined leg, said leg having an upwardly extending lip on its inner end for engaging the latch finger of the lower one of said latch members.

6. An article clamp as described in claim 5 wherein said jaws have inwardly projecting vertical reinforcement ribs, said ribs on said forward jaw being integral with said lip for reinforcing and stiffening said lip.

7. An article clamp as described in claim 6 wherein the upper edge of said opening has an inwardly extending leg, the inner end of said leg has a downwardly extending lip for engaging the latch finger of the upper one of said latch members.

* * * * *